United States Patent [19]

Yamada et al.

[11] Patent Number: 4,730,579

[45] Date of Patent: Mar. 15, 1988

[54] INTERNAL COMBUSTION ENGINE CYLINDER HEAD WITH PORT COOLANT PASSAGE INDEPENDENT OF AND SUBSTANTIALLY WIDER THAN COMBUSTION CHAMBER COOLANT PASSAGE

[75] Inventors: Toshio Yamada; Mutsumi Kanda; Yoshihiro Iwashita; Takeshi Okumura, all of Toyota, Japan

[73] Assignee: Toyota Jidosha Kabushiki Kaisha, Aichi, Japan

[21] Appl. No.: 892,825

[22] Filed: Aug. 1, 1986

[30] Foreign Application Priority Data

Aug. 2, 1985 [JP] Japan ..... 60-170696

[51] Int. Cl.[4] ..... F01P 3/02

[52] U.S. Cl. ..... 123/41.82 R; 123/193 H; 123/41.74

[58] Field of Search ..... 123/41.82 R, 41.74, 123/41.76, 41.77, 41.79, 193 H

[56] References Cited

U.S. PATENT DOCUMENTS 4,579,091 4/1986 Kashiwagi et al. ..... 123/41.82 R

FOREIGN PATENT DOCUMENTS 142412 6/1979 Japan ..... 123/41.82 R
206719 12/1982 Japan ..... 123/193 H
59-337 4/1983 Japan ..... 123/41.74
8429 1/1985 Japan ..... 123/193 H

*Primary Examiner*—William A. Cuchlinski, Jr.
*Attorney, Agent, or Firm*—Kenyon & Kenyon

[57] ABSTRACT

In an internal combustion engine cylinder head for being clamped to a cylinder block for defining therewith a plurality of combustion chambers arranged in a row, the cylinder head is formed with three parallel coolant passages along the row of combustion chambers, a first, a second and a third one of those passages successively passing by intake ports, exhaust ports and roofs of the row of combustion chambers, respectively, each passage being independently connected at one end thereof with a coolant jacket of the cylinder block to receive coolant therefrom, so that three parallel coolant flows of a favorable triple distribution of flow rates are optionally established according to certain relative magnitudes of flow resistance of the three coolant passages.

3 Claims, 2 Drawing Figures

INTERNAL COMBUSTION ENGINE CYLINDER HEAD WITH PORT COOLANT PASSAGE INDEPENDENT OF AND SUBSTANTIALLY WIDER THAN COMBUSTION CHAMBER COOLANT PASSAGE

BACKGROUND OF THE INVENTION

The present invention relates to a cylinder head for an internal combustion engine, and more particularly relates to such a cylinder head for an internal combustion engine, which is particularly improved with regard to the configuration of the coolant passages formed in the body thereof.

The present invention has been described in Japanese Patent Application Serial No. Showa 60-170696 (1985), filed by an applicant the same as the entity assigned or owed duty of assignment of the present patent application; and the present patent application hereby incorporates into itself by reference the text of said Japanese Patent Application and the claim and the drawings thereof; a copy is appended to the present application.

It is per se known in the art for liquid cooled type internal combustion engines to incorporate cylinder heads formed with internal coolant conduits for conducting the flow of coolant near to the parts of said cylinder heads which define the engine combustion chambers, so as to provide cooling for said cylinder heads and said combustion chambers. It is further a known fact in the art that the proper configuration and dimensions of these various coolant conduits is very crucial for determining the characteristics of the internal combustion engine, such as the performance thereof, the mechanical octane value thereof, and the volumetric efficiency obtained therefrom.

In order to improve the mechanical octane value of an internal combustion engine, it is important so to configure the coolant conduits in the cylinder head and the cylinder block thereof as well to cool the combustion chamber wall surface at its portions which present end gas knocking point portions. That is to say, the knocking point of an internal combustion engine is normally not in the central portion of the combustion chambers thereof, but rather is located on the side of the intake ports or on the side of the exhaust ports thereof - in most cases, in fact, on the side of the intake ports, because these tend to have a lower wall temperature than the exhaust ports, as well as experiencing a slow flame propagation speed in their vicinity. Knocking is created by the spontaneous ignition of air-fuel mixture at these regions.

Accordingly, in order to provide a good cooling effect for the above described knocking points so as to enhance the mechanical octane value of the engine, it is desirable that the intake port side region and the exhaust port side region of the cylinder head should be relatively powerfully cooled by the coolant flowing through the coolant flow passages of said cylinder head, and in view of this requirement a cylinder head formed with an improved coolant passage structure, relevant to the present invention, has been described in Japanese Patent Laying Open Publication Serial No. 58-35221 (1983).

SUMMARY OF THE INVENTION

It might be considered to be a good concept to more powerfully cool, by means of the coolant flowing through the cylinder head coolant conduits, the intake port side region and the exhaust port side region of the cylinder head, as compared to other portions of said cylinder head. Thus, it might be considered that it would be a good idea to divide said cylinder head coolant conduits into port region portions and other portions, and to circulate coolant of relatively lower temperature to said port region coolant conduit portions while circulating coolant of relatively higher temperature to said other coolant conduit portions. However, the coolant temperature control system required for such a system would be rather complicated, and would inevitably require many components and constituent elements.

In order powerfully to cool the combustion chamber wall surfaces with the flow of coolant through the coolant conduits, it would be desirable to increase the flow speed of said flow of coolant through said coolant conduits. However, normally, the cylinder head coolant conduits which cool the intake port side region and the exhaust port side region of the cylinder head pass transversely through cylinder head portions below the intake ports and the exhaust ports, and constitute so called intake port side and exhaust port side coolant conduits, and these conduits normally include portions of cross sectional areas small than that of the coolant passage which cools the central portions of the cylinder head and passes transversely therealong. Thus, the flow of coolant through these intake port side and exhaust port side coolant conduits is inevitably in the prior art rather restricted, and accordingly strong cooling effect for the intake port side region and the exhaust port side region of the cylinder head is not easily available in practice.

Accordingly, it is the primary object of the present invention to provide an internal combustion engine cylinder head, which avoids the above outlined problems.

It is a further object of the present invention to provide such an internal combustion engine cylinder head, the coolant conduit construction of which which provides specially good cooling effect for its intake port side region and its exhaust port side region.

It is a further object of the present invention to provide such an internal combustion engine cylinder head, which is simply constructed.

It is a yet further object of the present invention to provide such an internal combustion engine cylinder head, which does not require a cooling control system with a large number of constituent parts.

It is a yet further object of the present invention to provide such an internal combustion engine cylinder head, which enhances the mechanical octane value of the engine to which it is fitted.

It is a yet further object of the present invention to provide such an internal combustion engine cylinder head, which keeps engine volumetric efficiency high.

According to the most general aspect of the present invention, these and other objects are attained by an internal combustion engine cylinder head for being clamped to a cylinder block and for defining a combustion chamber between them, formed with: (a) a port for communicating said combustion chamber with the outside thereof; (b) a port coolant conduit passing between said port and said cylinder block, for passing coolant along to cool the portion of said cylinder head proximate to said port; and: (c) a combustion chamber coolant conduit, substantially separate from said port coolant conduit, and passing on the other side of said port from said port coolant conduit and generally proximate to the portion of said cylinder head which defines said roof portion of said combustion chamber, for passing coolant along to cool the portion of said cylinder head proximate to said combustion chamber; (d) the minimum cross sectional area of said combustion chamber coolant conduit being substantially smaller than the minimum cross sectional area of said port coolant conduit. Optionally, in this internal combustion engine cylinder head, said port may be an intake port. Further, optionally, in such an internal combustion engine cylinder head, there may be further formed an exhaust port and an exhaust port coolant conduit may be formed as passing between said exhaust port and said cylinder block, for passing coolant along to cool the portion of said cylinder head proximate to said exhaust port. In this case, the minimum cross sectional area of said exhaust port coolant conduit may be approximately equal to the minimum cross sectional area of said intake port coolant conduit; or, alternatively, the minimum cross sectional area of said exhaust port coolant conduit may be substantially less than the minimum cross sectional area of said intake port coolant conduit.

In this cylinder head as described above, the coolant flow volume through the port coolant conduit is substantially greater than the coolant flow volume through the combustion chamber coolant conduit, due to the lower flow resistance thereof caused by the higher minimum cross sectional area thereof, and this means that the combustion chamber wall surfaces at the intake port region and the exhaust port region of the combustion chamber are effectively relatively strongly cooled by the flow of coolant. Thus, the mechanical octane value of the internal combustion engine is raised, and the occurrence of knocking is restricted. Further, the effective cooling of the intake port region and the exhaust port region combustion chamber wall surfaces enables the prevention of drop in engine volumetric efficiency due to rise in the temperature of the air-fuel mixture sucked into the combustion chambers through the intake ports, and this enhances the volumetric efficiency of the internal combustion engine.

BRIEF DESCRIPTION OF THE DRAWINGS

The present invention will now be described with respect to the preferred embodiment thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified; like reference numerals, unless otherwise so specified, denote the same parts and gaps and spaces and so on in the various figures; and:

DESCRIPTION OF THE PREFERRED EMBODIMENT

Figure 1:
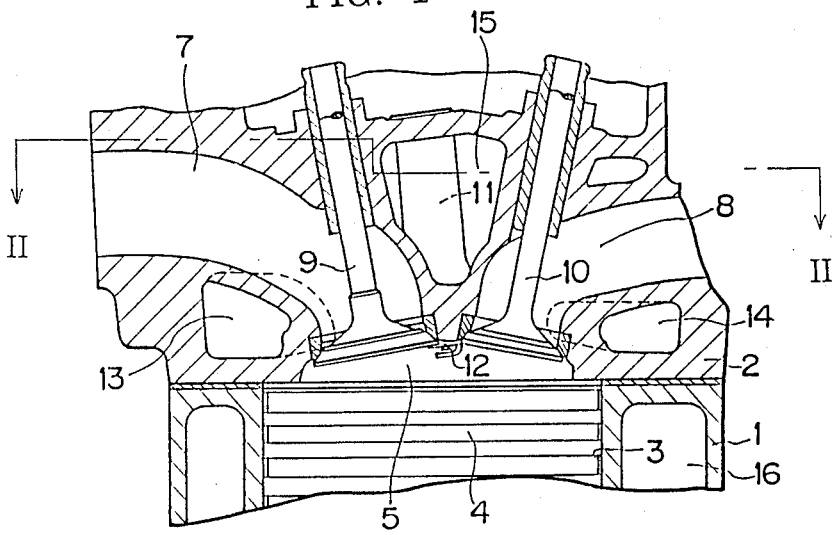
FIG. 1 is a partial sectional view of a cylinder block and a cylinder head of an internal combustion engine, and of a combustion chamber defined therebetween, taken in a plane including the central longitudinal axis of one of several cylinder bores of said cylinder block and perpendicular to the longitudinal direction of said cylinder block along the line of said several cylinders thereof, said cylinder head being the preferred embodiment of the cylinder head of the present invention.

The present invention will now be described with reference to the preferred embodiment thereof, and with reference to the figures. The view of FIG. 1 shows a partial sectional view of an internal combustion engine which comprises a cylinder block denoted by the reference numeral 1 and a cylinder head, which is the preferred embodiment of the cylinder head of the present invention, denoted by the reference numeral 2. The cylinder block 1 is formed with a plurality of cylinder bores 3 of which only one is shown in FIG. 1 because the section of FIG. 1 is taken in a plane including the central longitudinal axis of said shown cylinder bore 3 and substantially perpendicular to the plane including the central longitudinal axes of all said cylinder bores 3. In this cylinder bore 3 there reciprocates a piston 4, and between said piston 4, said cylinder head 2, and the upper portion of said cylinder bore 3 there is defined a combustion chamber 5 for this piston and cylinder. And the fitting of the cylinder head 2 to the cylinder block 1 is done by the use of cylinder head bolts, not particularly shown, fitted through cylinder head bolt holes 36 formed in bosses 37 formed in the cylinder head 2 between each pair of adjacent cylinders and at the ends of the row of cylinders, as particularly shown in the FIG. 2 view.

Figure 2:
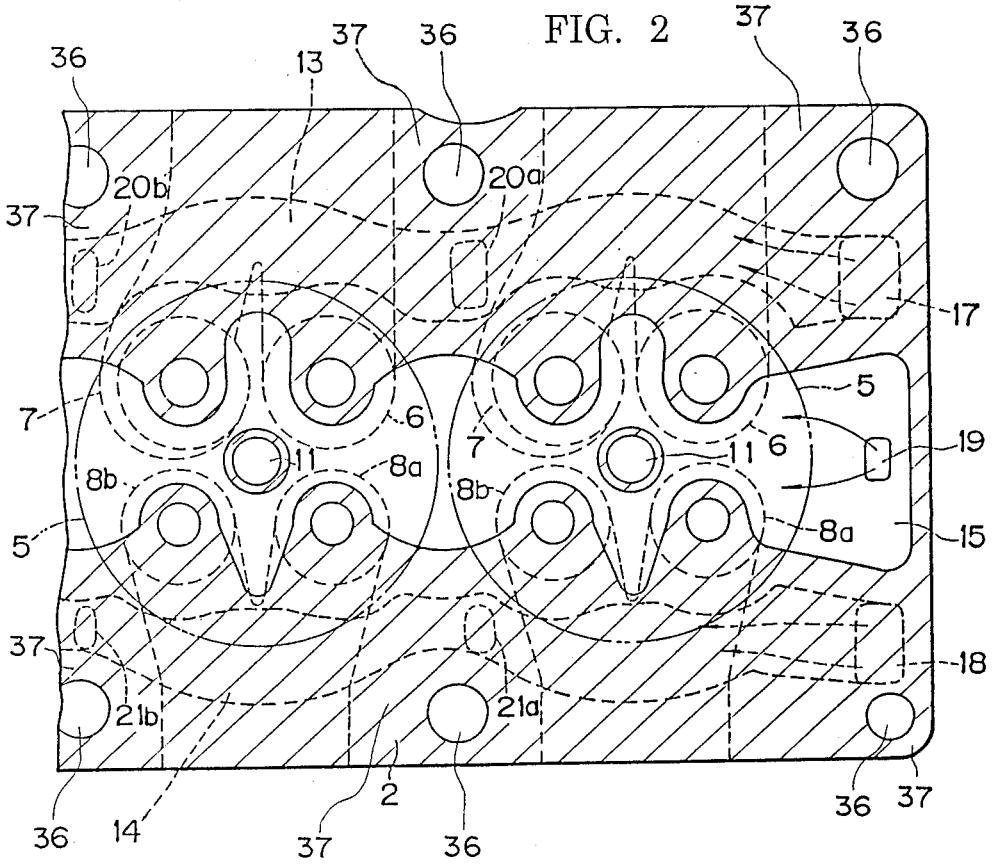
FIG. 2 is a partial transverse sectional view of a portion of said cylinder head taken in a plane shown by the arrows II—II in FIG. 1.

For each cylinder, the cylinder head 2 is formed with two intake ports 6 and 7 and two exhaust ports 8*a* and 8*b*, all four of which which open via respective valve seats to the combustion chamber 5, with the centers of said four valve seats approximately at the corners of a square, as generally shown in FIG. 2. Thus, this internal combustion engine is of the four valve per cylinder type. And the intake ports 6 and 7 for the various cylinders of this engine are all arranged on the one side of the cylinder block 1 and the cylinder head 2, in the longitudinal direction of said cylinder head 2 along the row of cylinders thereof, which corresponds to the direction perpendicular to the drawing paper in FIG. 1 and to the horizontal direction in FIG. 2; and, similarly, the exhaust ports 8*a* and 8*b* for the various cylinders are all arranged on the other side to said one side of the cylinder block 1 and of the cylinder head 2, again in the horizontal direction of said cylinder head 2 as seen in FIG. 2 along the row of cylinders thereof. Poppet valves 9 (of which only one can be seen in the sectional view of FIG. 1) of a per se known type, mounted in per se known valve guides fitted in the cylinder head 2, are provided for cooperating with intake valve seats inset around the edges of each of the intake ports 6 and 7 where they open to the combustion chamber 5, so as to provide open/close control of communication between said intake ports 6 and 7 and the combustion chamber 5; and two other poppet valves 10, also per se known and mounted in per se known valve guides fitted in the cylinder head 2, and again only one of which can be seen in FIG. 1, are provided for similarly cooperating with exhaust valve seats inset around the edges of the exhaust ports 8*a* and 8*b* where they open to the combustion chamber 5, so as similarly to provide open/close control of communication between the communication between said exhaust ports 8*a* and 8*b* and said combustion chamber 5. And by actuation of these intake poppet valves 9 and exhaust poppet valves 10 by a per se known type of valve gear not particularly shown, the internal combustion engine is caused to operate according to an Otto cycle so as to generate rotational power, as is per se conventional.

As best seen in FIG. 2, substantially in the middle of the portion of the cylinder head 2 defining the roof of the combustion chamber 5 there is formed a screwed hole 11 for fitting a spark plug 12 thereinto. And said portion of the cylinder head 2 defining said roof of said combustion chamber 5 and the engine piston 4 are so formed as to define between them squish areas in the combustion chamber 5, not particularly relevant to the present invention.

Through the cylinder head 2 there is formed a system of coolant passages for admitting flow of a coolant such as water for cooling said cylinder head 2, said coolant passages extending generally in the direction perpendicular to the drawing paper in FIG. 1 and in the horizontal direction as seen in FIG. 2, generally along the line of the cylinders of the internal combustion engine. This system of coolant passages includes, according to the concept of the present invention, three independent passages which are not directly communicated together, all of which extend generally in the longitudinal direction of the row of cylinders: an intake port side lower coolant passage 13 which generally passes between each of the intake ports 6 and 7 and the parts of the lower surface of the cylinder head 2 which define the intake port side squish areas; an exhaust port side lower coolant passage 14 which generally passes between each of the exhaust ports 8*a* and 8*b* and the parts of the lower surface of the cylinder head 2 which define the exhaust port side squish areas; and a central combustion chamber side higher coolant passage 15 which generally passes between the row of the intake ports 6 and 7 and the row of the exhaust ports 8*a* and 8*b*, around the spark plug holes 11 and the spark plugs 12, and over the part of the lower surface of the cylinder head 2 which defines the central portions of the roofs of the combustion chambers 5. These three coolant passages 13, 14, and 15 provide substantially mutually independent flow routes for coolant, from their upstream ends to their downstream ends, as will now be described.

In detail, the cylinder block 1 is formed with a coolant conduit system 16, and from a portion of this system 16 on the right hand side from the point of view of FIG. 2, i.e. at one end of the row of cylinders 3 of the internal combustion engine, coolant flows through a first upstream aperture 17 into the upstream end of the intake port side lower coolant passage 13, through a second upstream aperture 18 into the upstream end of the exhaust port side lower coolant passage 14, and through a third upstream aperture 19 into the upstream end of the central combustion chamber side higher coolant passage 15. Similarly, although this portion of the construction is not particularly shown in the figures, this coolant, after having flowed through the intake port side lower coolant passage 13, the exhaust port side lower coolant passage 14, and the central combustion chamber side higher coolant passage 15 and having cooled the relevant adjoining portions of the cylinder head 2, flows through downstream apertures from the downstream ends of these coolant passages back into to a portion of the coolant conduit system 16 on the left hand side from the point of view of FIG. 2, i.e. at the other end of the row of cylinders 3 of the internal combustion engine.

These intake and exhaust port side lower coolant passages 13 and 14 and this central combustion chamber side higher coolant passage 15 are of varying cross sectional areas along their lengths, but only their minimum cross sectional areas are substantially relevant from the point of view of determining their flow resistance. According to one feature of the shown preferred embodiment of the present invention, the third upstream aperture 19 which opens to the upstream end of the central combustion chamber side higher coolant passage 15 is comparatively small, and should constitute the portion of said central combustion chamber side higher coolant passage 15 which is of the minimum cross sectional area. And this minimum cross sectional area of the central combustion chamber side higher coolant passage 15 is arranged to be from about one third to about two thirds of the minimum cross sectional area of the intake port side lower coolant passage 13. According to one possible variant of a particular feature of the shown preferred embodiment of the present invention, the minimum cross sectional areas of the intake port side lower coolant passage 13 and the exhaust port side lower coolant passage 14 may be generally similar or equivalent, both being therefore substantially larger than the minimum cross sectional area of the central combustion chamber side higher coolant passage 15; while on the other hand according to an alternative possible such variant the minimum cross sectional area of the exhaust port side lower coolant passage 14 may be substantially less than said minimum cross sectional area of the intake port side lower coolant passage 13, and more particularly may be approximately one third thereof.

The intake port side lower coolant passage 13 is further communicated to the coolant conduit system 16 in the cylinder block 1 via a series of intermediate apertures 20*a*, 20*b*, etc. (only two thereof are shown in FIG. 2), and these apertures 20 become smaller in the downstream direction of said intake port side lower coolant passage 13. Similarly, the exhaust port side lower coolant passage 14 is further communicated to said coolant conduit system 16 in the cylinder block 1 via a series of intermediate apertures 21*a*, 21*b*, etc. (again, only two thereof are shown in FIG. 2), and these apertures 21 similarly become smaller in the downstream direction of said exhaust port side lower coolant passage 14. Thereby, coolant flowing in the coolant conduit system 16 is also supplied to the intake port side lower coolant passage 13 and the exhaust port side lower coolant passage 14 via these sets of apertures 20 and 21 respectively, and according to the diminishing of the sizes of said apertures 20 and 21 in the downstream directions of their conduits the equalization of the temperature of the coolant in each of the coolant passages from cylinder to cylinder along the row of engine cylinders is assured.

This cylinder head as described above functions as follows. When a coolant pump, not particularly shown or described herein, pumps coolant into the coolant conduit system 16 in the cylinder block 1, this coolant flows through the first, second and third communication apertures 17, 18, and 19 and also through the apertures 20 and 21 into the upstream ends of, respectively, the intake and exhaust port side lower coolant passages 13 and 14, and the central combustion chamber side higher coolant passage 15. This coolant then flows along these three mutually independent flow routes through the cylinder head 2, along the row of the engine cylinders, and towards and out through the downstream outlet ends, not particularly shown, of said coolant passages 13, 14, and 15. Since the one of said three mutually independent flow routes through the cylinder head 2 which has the largest minimum cross sectional area and therefore the lowest flow resistance is the intake port side lower coolant passage 13, the flow of coolant through said intake port side lower coolant passage 13 is greater as compared to the other two said coolant passages; and hence the intake port regions of the internal combustion engine cylinder head and combustion chamber are more powerfully cooled than are the other regions thereof, and thereby the likelihood of the occurrence of knocking of the engine is significantly reduced, and further the mechanical octane value of the engine is increased. Also, the rise in temperature of the air-fuel mixture sucked in through the intake ports of the engine is stemmed and restrained, and thereby the volumetric efficiency of the engine is enhanced, thus allowing for good engine power output and efficiency.

Although the present invention has been shown and described in terms of the preferred embodiment thereof, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiment, or of the drawings, but solely by the scope of the accompanying claims, which follow.

What is claimed is:

1. An internal combustion engine cylinder head for being clamped to a cylinder block for defining therewith a plurality of combustion chambers arranged in a row, said cylinder block having a coolant jacket, said cylinder head being formed with:

a plurality of intake ports each being opened in a first half side portion of each one of said combustion chambers for introducing intake air or mixture therein;

a plurality of exhaust ports each being opened in a second half side portion opposite to said first half side portion of each one of said combustion chambers for exhausting combustion gases therefrom;

a first coolant passage disposed along the row of said plurality of combustion chambers adjacent said plurality of intake ports so as successively to pass thereby as located on one side thereof remote from central roof portions of said combustion chambers;

a second coolant passage disposed along the row of said plurality of combustion chambers adjacent said pluruality of exhaust ports so as successively to pass thereby as located on one side thereof remote from said central roof portions of said combustion chambers; and a third coolant passage disposed along the row of said plurality of combustion chambers adjacent said central roof portions of said combustion chambers so as successively to pass thereby;

said first, second and third coolant passages each being independently connected at one end thereof with said coolant jacket of said cylinder block so as individually to receive coolant therefrom, thereby establislhing three parallel flows of coolant through said first, second and third coolant passages with a predetermined triple distribution of flow rates according to certain relative magnitudes of flow resistance of said three coolant passages.

2. A cylinder head according to claim 1, wherein said first, second and third coolant passages are each connected further at an intermediate portion thereof with said coolant jacket of said cylinder block.

3. A cylinder head according to claim 1, wherein said certain relative magnitudes of flow resistance of said three coolant passages are primarily determined by relative magnitudes of cross sectional area of openings at which said first, second and third coolant passages are connected with said coolant jacket of said cylinder block.

* * * * *